US008585510B1

(12) United States Patent
Ehlers et al.

(10) Patent No.: US 8,585,510 B1
(45) Date of Patent: Nov. 19, 2013

(54) GOLF CLUB HEAD WITH IMPROVED AERODYNAMIC CHARACTERISTICS

(75) Inventors: Steven M. Ehlers, Poway, CA (US); D. Clayton Evans, San Marcos, CA (US); Matthew T. Cackett, San Diego, CA (US)

(73) Assignee: Callaway Golf Company, Carlsbad, CA (US)

( * ) Notice: Subject to any disclaimer, the term of this patent is extended or adjusted under 35 U.S.C. 154(b) by 291 days.

(21) Appl. No.: 13/219,488

(22) Filed: Aug. 26, 2011

Related U.S. Application Data

(60) Provisional application No. 61/378,340, filed on Aug. 30, 2010, provisional application No. 61/378,343, filed on Aug. 30, 2010, provisional application No. 61/378,502, filed on Aug. 31, 2010, provisional application No. 61/378,635, filed on Aug. 31, 2010, provisional application No. 61/379,039, filed on Sep. 1, 2010, provisional application No. 61/379,449, filed on Sep. 2, 2010, provisional application No. 61/380,007, filed on Sep. 3, 2010.

(51) Int. Cl.
*A63B 53/02* (2006.01)

(52) U.S. Cl.
USPC ..... 473/305; 473/307; 473/314; 473/315; 473/317; 473/327; 473/345; 473/349

(58) Field of Classification Search
USPC ..... 473/305, 307, 314, 315, 317, 327, 329, 473/342, 345, 349
See application file for complete search history.

(56) References Cited

U.S. PATENT DOCUMENTS

| | | | | |
|---|---|---|---|---|
| 1,587,758 | A | 6/1926 | Charavay | |
| D118,594 | S | 1/1940 | Heddon | |
| 3,595,577 | A | 7/1971 | Hodge | |
| 3,693,978 | A * | 9/1972 | East | 473/314 |
| 4,065,133 | A | 12/1977 | Gordos | |
| 4,930,783 | A | 6/1990 | Antonious | |
| 5,120,061 | A | 6/1992 | Tsuchida et al. | |
| 5,163,682 | A | 11/1992 | Schmidt et al. | |
| 5,203,565 | A | 4/1993 | Murray et al. | |
| 5,251,896 | A | 10/1993 | Gerlach | |
| 5,318,297 | A | 6/1994 | Davis et al. | |
| 5,318,300 | A | 6/1994 | Schmidt et al. | |
| 5,335,908 | A | 8/1994 | Bamber | |
| 5,474,296 | A | 12/1995 | Schmidt et al. | |
| 5,575,725 | A | 11/1996 | Olsavsky | |
| 5,630,766 | A * | 5/1997 | Granelli | 473/313 |
| 5,674,136 | A | 10/1997 | Gorse et al. | |
| 5,830,084 | A | 11/1998 | Kosmatka | |
| D401,991 | S | 12/1998 | Collins | |

(Continued)

*Primary Examiner* — Benjamin Layno
(74) *Attorney, Agent, or Firm* — Rebecca Hanovice; Michael A. Catania; Sonia Lari

(57) ABSTRACT

A golf club head (40) with a face component (50), an aft body (70), and an aerodynamic hosel (50) is disclosed herein. The hosel (50) is connected to the club head (40) at a head connection point (55) and to a shaft at a shaft connection point (57), and a YZ plane (85) defined by a y-axis and an x-axis that intersects the center of gravity (80) also intersects the head connection portion (55) of the hosel (50). In one further embodiment, a plane (95) aligned with the hosel (50) is parallel to an XZ plane (90) defined by the horizontal x-axis and the vertical z-axis. In another further alternative embodiment, a plane (95) aligned with the hosel (50) intersects the XZ plane 90.

13 Claims, 12 Drawing Sheets

(56) References Cited

U.S. PATENT DOCUMENTS

| | | | | |
|---|---|---|---|---|
| 5,873,793 | A | 2/1999 | Swinford | |
| 5,921,870 | A | 7/1999 | Chiasson | |
| 5,938,541 | A | 8/1999 | Allen et al. | |
| 5,961,397 | A | 10/1999 | Lu et al. | |
| 5,971,868 | A | 10/1999 | Kosmatka | |
| 6,007,432 | A | 12/1999 | Kosmatka | |
| 6,027,414 | A | 2/2000 | Koebler | |
| 6,048,278 | A | 4/2000 | Meyer et al. | |
| 6,244,976 | B1 | 6/2001 | Murphy et al. | |
| 6,332,847 | B2 | 12/2001 | Murphy et al. | |
| 6,338,683 | B1 | 1/2002 | Kosmatka | |
| 6,354,962 | B1 | 3/2002 | Galloway et al. | |
| 6,368,234 | B1 | 4/2002 | Galloway et al. | |
| 6,386,990 | B1 | 5/2002 | Reyes et al. | |
| 6,398,666 | B1 | 6/2002 | Evans et al. | |
| 6,406,378 | B1 | 6/2002 | Murphy et al. | |
| 6,413,169 | B1 | 7/2002 | Kosmatka et al. | |
| 6,428,426 | B1 | 8/2002 | Helmstetter et al. | |
| 6,435,977 | B1 | 8/2002 | Helmstetter et al. | |
| 6,440,008 | B2 | 8/2002 | Murphy et al. | |
| 6,471,604 | B2 | 10/2002 | Hocknell et al. | |
| 6,478,692 | B2 | 11/2002 | Kosmatka | |
| 6,491,592 | B2 | 12/2002 | Cackett et al. | |
| 6,508,978 | B1 | 1/2003 | Deshmukh | |
| 6,527,650 | B2 | 3/2003 | Reyes et al. | |
| 6,561,922 | B2 | 5/2003 | Bamber | |
| 6,565,452 | B2 | 5/2003 | Helmstetter et al. | |
| 6,575,845 | B2 | 6/2003 | Galloway et al. | |
| 6,582,323 | B2 | 6/2003 | Soracco et al. | |
| 6,592,466 | B2 | 7/2003 | Helmstetter et al. | |
| 6,602,149 | B1 | 8/2003 | Jacobson | |
| 6,607,452 | B2 | 8/2003 | Helmstetter et al. | |
| 6,612,398 | B1 | 9/2003 | Tokimatsu et al. | |
| 6,623,377 | B2 | 9/2003 | Evans et al. | |
| 6,663,504 | B2 | 12/2003 | Hocknell et al. | |
| 6,669,578 | B1 | 12/2003 | Evans | |
| 6,739,982 | B2 | 5/2004 | Helmstetter et al. | |
| 6,758,763 | B2 | 7/2004 | Murphy et al. | |
| 6,860,824 | B2 | 3/2005 | Evans | |
| 6,994,637 | B2 | 2/2006 | Murphy et al. | |
| 6,997,821 | B2 | 2/2006 | Galloway et al. | |
| 7,014,570 | B2 | 3/2006 | Evans et al. | |
| 7,025,692 | B2 | 4/2006 | Erickson et al. | |
| 7,070,517 | B2 | 7/2006 | Cackett et al. | |
| 7,101,289 | B2 * | 9/2006 | Gibbs et al. | 473/329 |
| 7,112,148 | B2 | 9/2006 | Deshmukh | |
| 7,118,493 | B2 | 10/2006 | Galloway | |
| 7,121,957 | B2 | 10/2006 | Hocknell et al. | |
| 7,125,344 | B2 | 10/2006 | Hocknell et al. | |
| 7,128,661 | B2 | 10/2006 | Soracco et al. | |
| 7,137,907 | B2 | 11/2006 | Gibbs et al. | |
| 7,144,334 | B2 | 12/2006 | Ehlers et al. | |
| 7,163,463 | B2 * | 1/2007 | Mills | 473/244 |
| 7,163,468 | B2 | 1/2007 | Gibbs et al. | |
| 7,163,470 | B2 | 1/2007 | Galloway et al. | |
| 7,166,038 | B2 | 1/2007 | Williams et al. | |
| 7,169,060 | B2 | 1/2007 | Stevens et al. | |
| 7,214,143 | B2 | 5/2007 | Deshmukh | |
| 7,226,366 | B2 | 6/2007 | Galloway | |
| 7,252,600 | B2 | 8/2007 | Murphy et al. | |
| 7,258,626 | B2 | 8/2007 | Gibbs et al. | |
| 7,258,631 | B2 | 8/2007 | Galloway et al. | |
| 7,273,419 | B2 | 9/2007 | Evans et al. | |
| 7,278,927 | B2 | 10/2007 | Gibbs et al. | |
| 7,291,075 | B2 | 11/2007 | Williams et al. | |
| 7,306,527 | B2 | 12/2007 | Williams et al. | |
| 7,311,613 | B2 | 12/2007 | Stevens et al. | |
| 7,314,418 | B2 | 1/2008 | Galloway et al. | |
| 7,320,646 | B2 | 1/2008 | Galloway | |
| 7,387,577 | B2 | 6/2008 | Murphy et al. | |
| 7,390,269 | B2 | 6/2008 | Williams et al. | |
| 7,396,296 | B2 | 7/2008 | Evans | |
| 7,402,112 | B2 | 7/2008 | Galloway | |
| 7,407,448 | B2 | 8/2008 | Stevens et al. | |
| 7,410,428 | B1 | 8/2008 | Dawson et al. | |
| 7,413,519 | B1 | 8/2008 | Dawson et al. | |
| 7,413,520 | B1 | 8/2008 | Hocknell et al. | |
| 7,419,440 | B2 | 9/2008 | Williams et al. | |
| 7,431,667 | B2 | 10/2008 | Vincent et al. | |
| 7,438,647 | B1 | 10/2008 | Hocknell | |
| 7,448,960 | B2 | 11/2008 | Gibbs et al. | |
| 7,455,598 | B2 | 11/2008 | Williams et al. | |
| 7,476,161 | B2 | 1/2009 | Williams et al. | |
| 7,491,134 | B2 | 2/2009 | Murphy et al. | |
| 7,494,424 | B2 | 2/2009 | Williams et al. | |
| 7,497,787 | B2 | 3/2009 | Murphy et al. | |
| 7,549,935 | B2 | 6/2009 | Foster et al. | |
| 7,578,751 | B2 | 8/2009 | Williams et al. | |
| 7,588,501 | B2 | 9/2009 | Williams et al. | |
| 7,591,737 | B2 | 9/2009 | Gibbs et al. | |
| 7,717,807 | B2 | 5/2010 | Evans et al. | |
| 7,749,096 | B2 | 7/2010 | Gibbs et al. | |
| 7,749,097 | B2 | 7/2010 | Foster et al. | |
| D629,475 | S | 12/2010 | Rollinson | |
| D630,690 | S | 1/2011 | Rollinson | |
| 2005/0032584 | A1 | 2/2005 | Van Nimwegen | |
| 2009/0318245 | A1 | 12/2009 | Yim et al. | |
| 2010/0009771 | A1 | 1/2010 | Newcomer | |
| 2010/0016095 | A1 | 1/2010 | Burnett et al. | |
| 2010/0016096 | A1 | 1/2010 | Burnett et al. | |
| 2010/0016097 | A1 | 1/2010 | Albertsen et al. | |
| 2010/0178997 | A1 | 7/2010 | Gibbs et al. | |
| 2010/0292020 | A1 | 11/2010 | Tavares et al. | |
| 2010/0311517 | A1 | 12/2010 | Tavares et al. | |
| 2011/0136584 | A1 * | 6/2011 | Boyd et al. | 473/327 |

* cited by examiner

GOLF CLUB HEAD WITH IMPROVED AERODYNAMIC CHARACTERISTICS

CROSS REFERENCES TO RELATED APPLICATIONS

The present application claims priority to U.S. Provisional Patent Application No. 61/378,340, filed on Aug. 30, 2010, U.S. Provisional Patent Application No. 61/378,343, filed on Aug. 30, 2010, U.S. Provisional Patent Application No. 61/378,502, filed on Aug. 31, 2010, U.S. Provisional Patent Application No. 61/378,635, filed on Aug. 31, 2010, U.S. Provisional Patent Application No. 61/379,039, filed on Sep. 1, 2010, U.S. Provisional Patent Application No. 61/379,449, filed on Sep. 2, 2010, and U.S. Provisional Patent Application No. 61/380,007, filed on Sep. 3, 2010.

STATEMENT REGARDING FEDERALLY SPONSORED RESEARCH OR DEVELOPMENT

Not Applicable

BACKGROUND OF THE INVENTION

1. Field of the Invention

The present invention relates to a golf club head having a hosel configuration that improves the aerodynamic qualities of the golf club head. More specifically, the present invention relates to wood-type golf club heads. Even more specifically, the present invention relates to drivers.

2. Description of the Related Art

Technical innovation in the configuration, material, construction and performance of golf clubs has resulted in a variety of new products. The advent of metals as a structural material has largely replaced natural wood for wood-type golf club heads, and is but one example of this technical innovation resulting in a major change in the golf industry. Another important example is the use of composite or plastic materials to form components of golf club heads, including the face, crown, and/or sole.

The Rules of Golf, established and interpreted by the United States Golf Association ("USGA") and The Royal and Ancient Golf Club of Saint Andrews, set forth certain requirements for a golf club head. The requirements for a golf club head are found in Rule 4 and Appendix II. Complete descriptions of the Rules of Golf are available on the USGA web page at www.usga.org. According to the Rules, the shaft of a golf club must be attached to a wood club head at the club head heel either directly or through a single plain neck and/or socket. The length from the top of the neck and/or socket to the sole of the club must not exceed 5 inches (127 mm), measured along the axis of, and following any bend in, the neck and/or socket.

Although the prior art has disclosed many variations of golf club heads, the prior art has failed to provide a club head with a hosel configuration that does not interfere with or have a negative affect on airflow over the crown of the club head during a swing.

BRIEF SUMMARY OF THE INVENTION

The inventors have found that, by moving the connection point between the hosel and the club head further away from the face of the club head in comparison with prior art hosel configurations, the hosel has less opportunity to create undesired air flow interference with an airstream as it moves over and around the crown of the club head during a swing. In order to have optimal head and face alignment with the ball during set up, address, and impact, however, it is desirable to design the club head so that a shaft axis remains close to the face and is biased towards the heel. The present invention provides a solution to this problem by including a hosel configuration that has an optimal shaft axis location and an optimal hosel connection point such that the air flow interference can be reduced without negatively affecting the alignment of the club head with a golf ball.

One aspect of the present invention is a golf club head comprising a face component, an aft body comprising a crown, a sole, a heel section, and a toe section, a hosel having a head connection portion, and a center of gravity located at coordinates defined by an x-axis extending from the face towards a rear portion of the club head, a y-axis extending from the heel section towards the toe section, and a z-axis extending from the sole to the crown, and wherein a YZ plane defined by the y-axis and the z-axis that intersects the center of gravity also intersects the head connection portion. The present invention may further include a hosel plane that is parallel to an XZ plane defined by the x-axis and the z-axis. Alternatively, the present invention may further include a hosel plane that intersects an XZ plane defined by the x-axis and the z-axis.

Another aspect of the present invention is a golf club head comprising a face, an aft body comprising a crown and a sole, and a hosel having a head connection portion and a hosel plane, wherein the hosel plane is parallel to an XZ plane defined by an x axis extending horizontally from the face towards a rear portion of the golf club head and a z axis extending vertically from the sole to the crown.

Yet another aspect of the present invention is a golf club head comprising a face, an aft body comprising a crown and a sole, and a hosel having a head connection portion and a hosel plane, wherein the hosel plane intersects an XZ plane defined by an x axis extending horizontally from the face towards a rear portion of the golf club head and a z axis extending vertically from the sole to the crown.

The hosels of the embodiments described above may further have a cross-sectional shape is selected from a group consisting of circular, elliptical, airfoil, symmetrical, and non-uniform. In a further aspect of the present invention, at least part of the hosel has an airfoil cross-sectional shape, which may have a length of 0.25 to 1.50 inches, and more preferably a length that is less than or equal to 1.00 inch.

The embodiments described above may also have a striking portion with variable thickness. The golf club head embodiments described above may also have an overall shape selected from a group consisting of square, rectangular, and triangular. The embodiments described above may have a face or face component comprising a first material, a crown and sole comprising a second material, and a hosel comprising a third material. The embodiments described above may have a hosel constructed from of a lightweight material selected from the group consisting of composite, aluminum, titanium, magnesium, and plastic. The embodiments described above may have a hosel that is permanently affixed to the golf club head. Alternatively, the embodiments described above may have a hosel that is semi-permanently affixed to the golf club head.

DETAILED DESCRIPTION OF THE INVENTION

The present invention is generally directed to a golf club head with a novel hosel configuration that creates reduced interference with airflow over the crown of the club head during a swing in comparison with hosel configurations of the prior art.

Figure 1A:
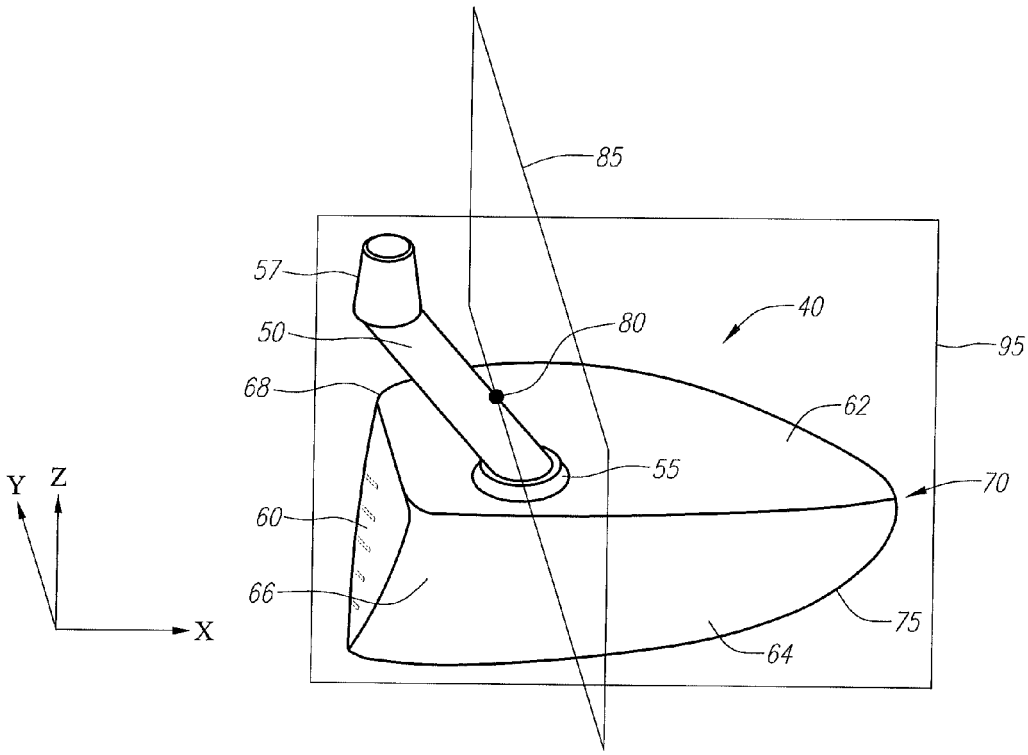
FIGS. 1A-1J are side perspective views of golf club heads according to first through tenth embodiments of the present invention.

As shown in FIG. 1A, a preferred embodiment of the golf club head 40 is generally designated. The golf club head 40 may have a hollow interior (not shown). As shown in FIG. 1A, the club head 40 is generally composed of a face 60, an aft body 70 comprising a crown 62 and a sole 64, and a hosel 50. In this embodiment, the hosel is swept back and straight. The club head 40 also may optionally have a ribbon, skirt, or side portion (not shown) disposed between the crown 62 and sole 64 portions. The golf club head 40 is preferably partitioned into a heel section 66 nearest the shaft hosel 50, a toe section 68 opposite the heel section 66, and a rear section 75 opposite the face component 60. The hosel 50 is connected to the club head 40 at a head connection portion 55 and to a shaft (not shown) at a shaft connection portion 57.

The golf club head 40 shown in FIG. 1A also has a center of gravity 80 located on a Cartesian coordinate system. The x-axis of the coordinate system extends along a horizontal axis extending from the face 60 to the rear section 75, the y-axis extends along a horizontal axis extending from the heel section 66 to the toe section 68, and the z-axis extends along a vertical axis from the sole 64 to the crown 62. In a most preferred embodiment of the present invention, a YZ plane 85 defined by the y-axis and the x-axis that intersects the center of gravity 80 also intersects the head connection portion 55 of the hosel 50. As shown in FIGS. 1A-1J, the YZ plane 85 can intersect any part of the head connection portion 55, but most preferably intersects the midpoint of the head connection portion 55 as shown in FIG. 1A. This configuration creates aerodynamic benefits and can reduce overall head drag.

Figure 1B:
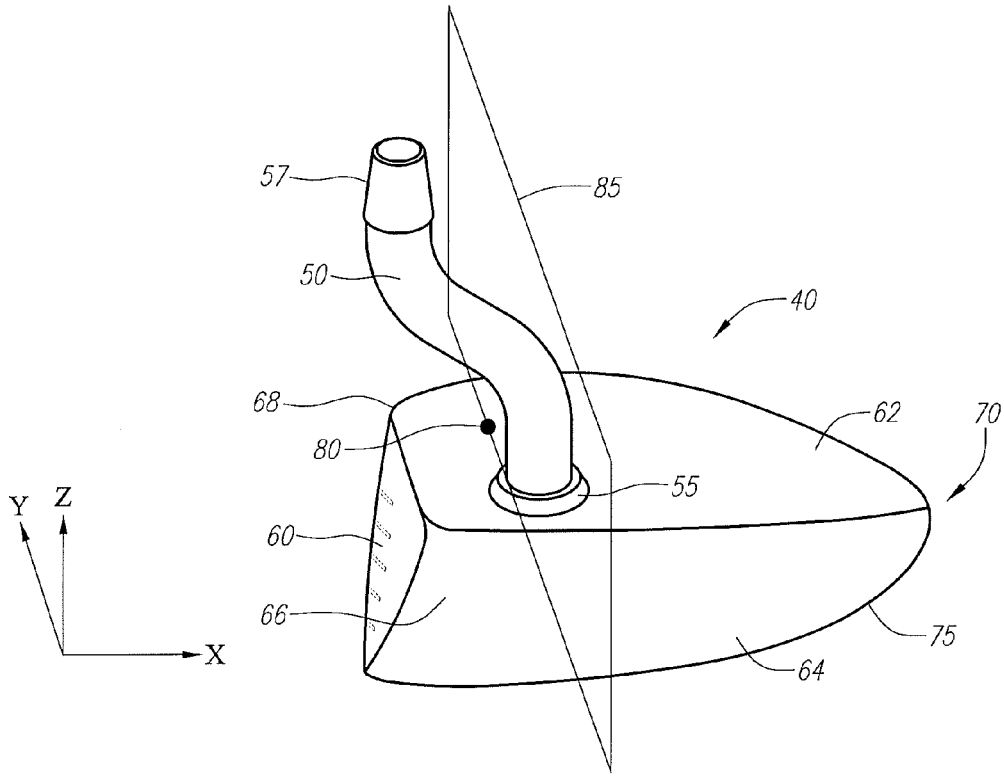
Figure 1C:
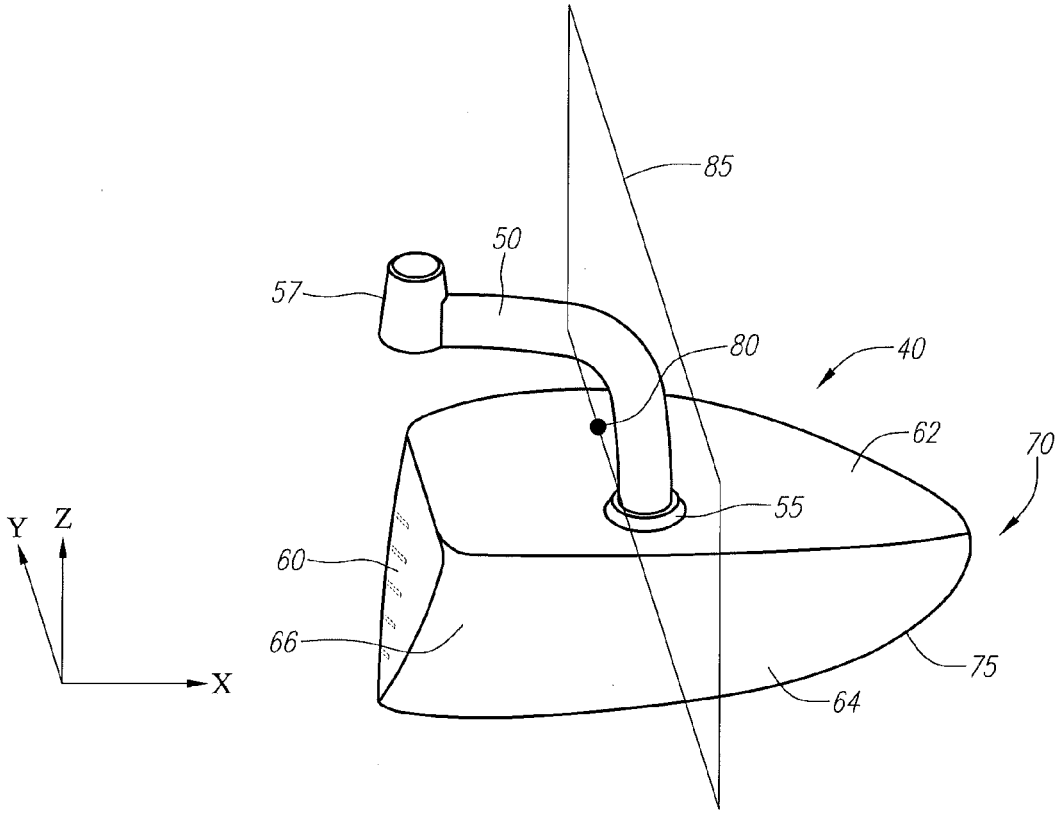
Figure 1D:
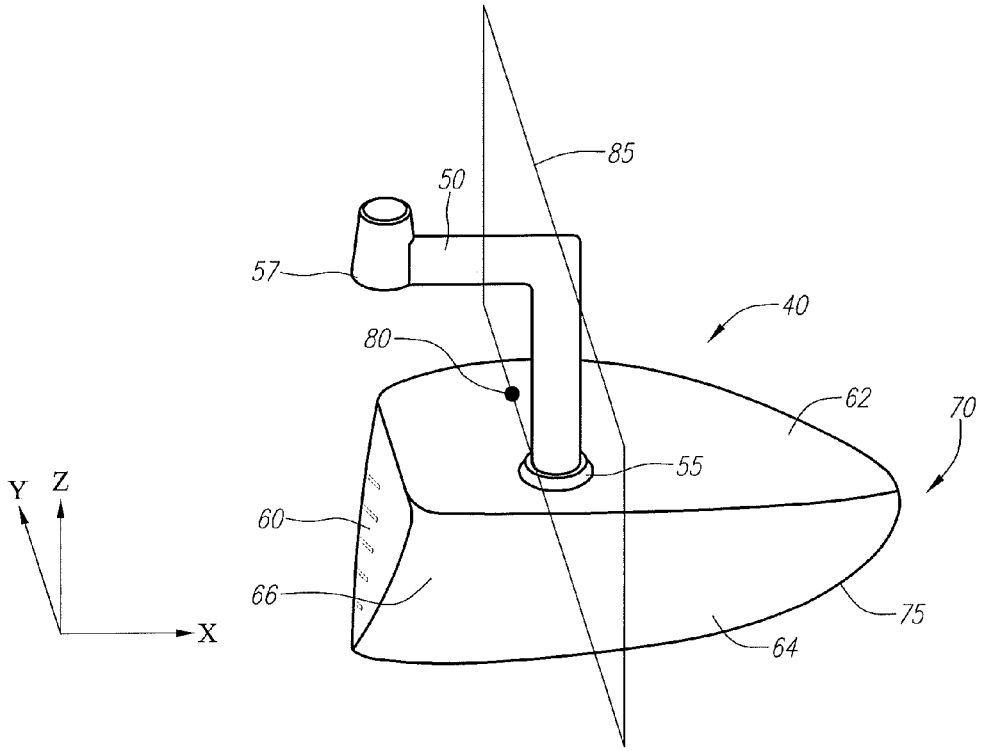
Figure 1E:
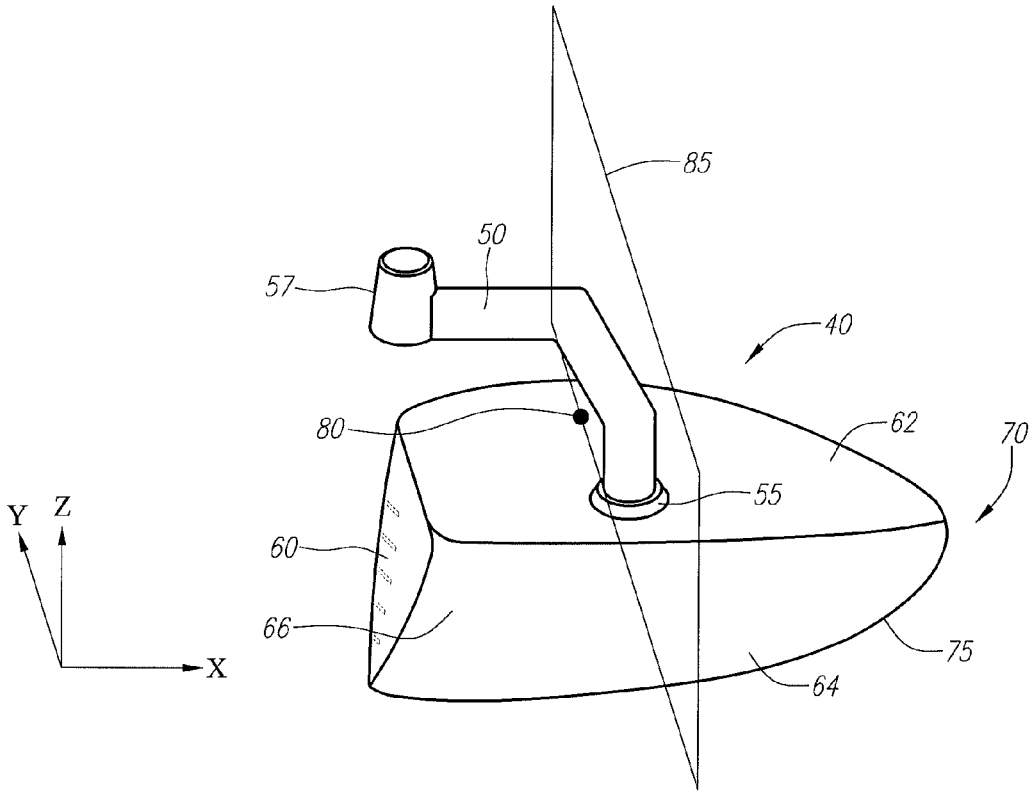
Figure 1F:
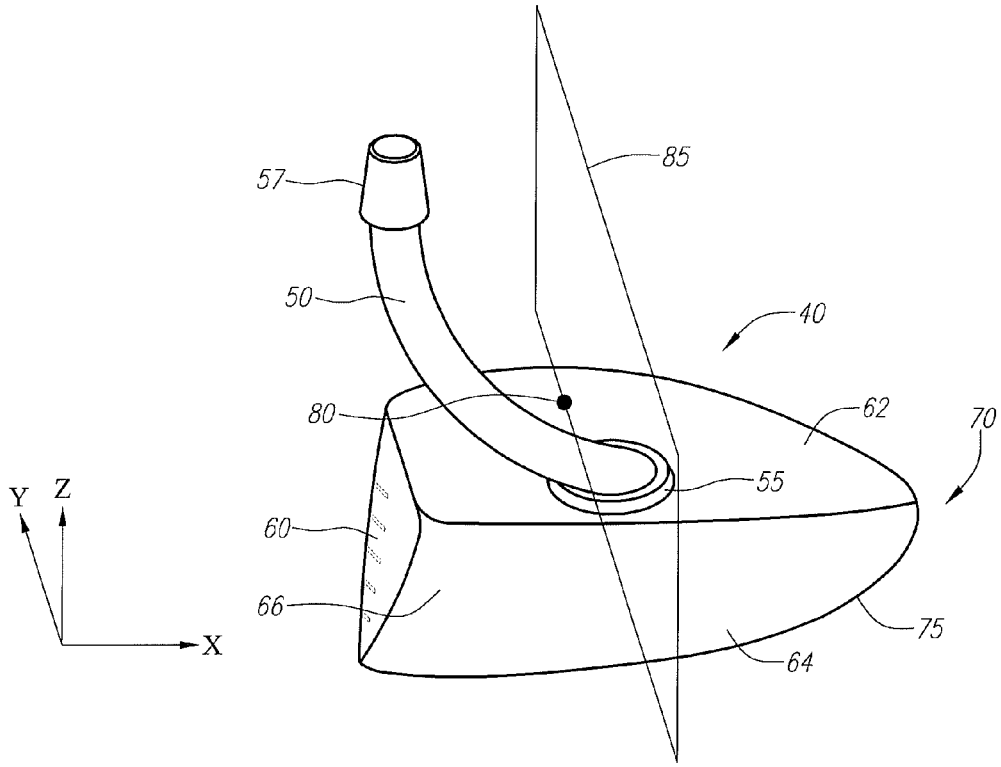
Figure 1G:
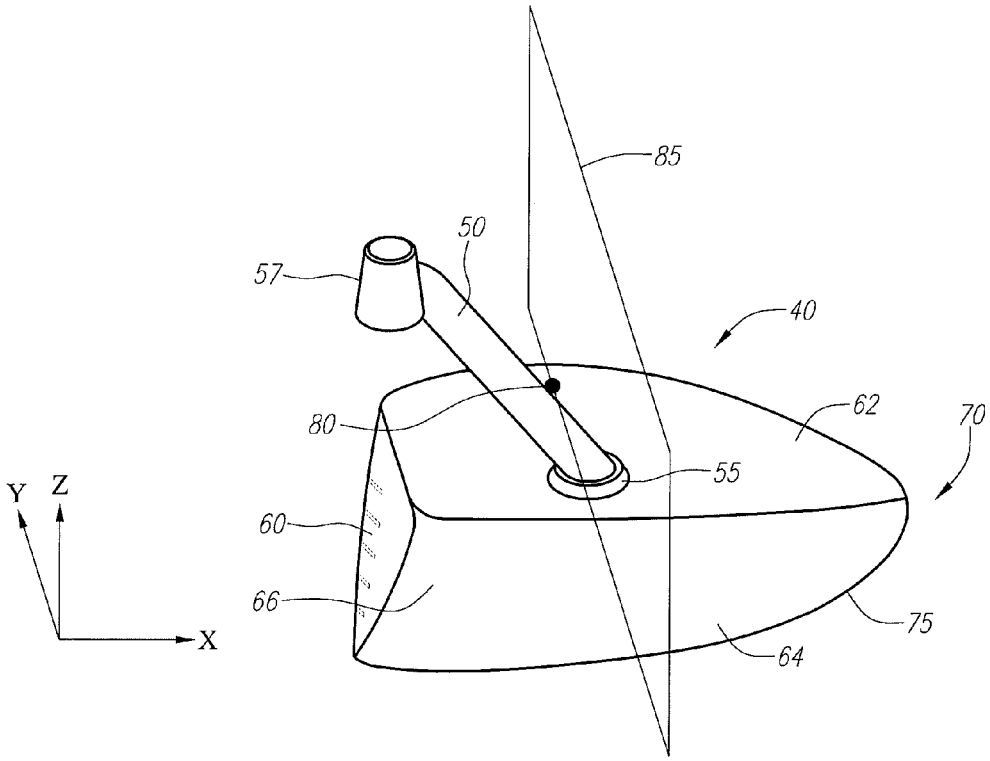
Figure 1H:
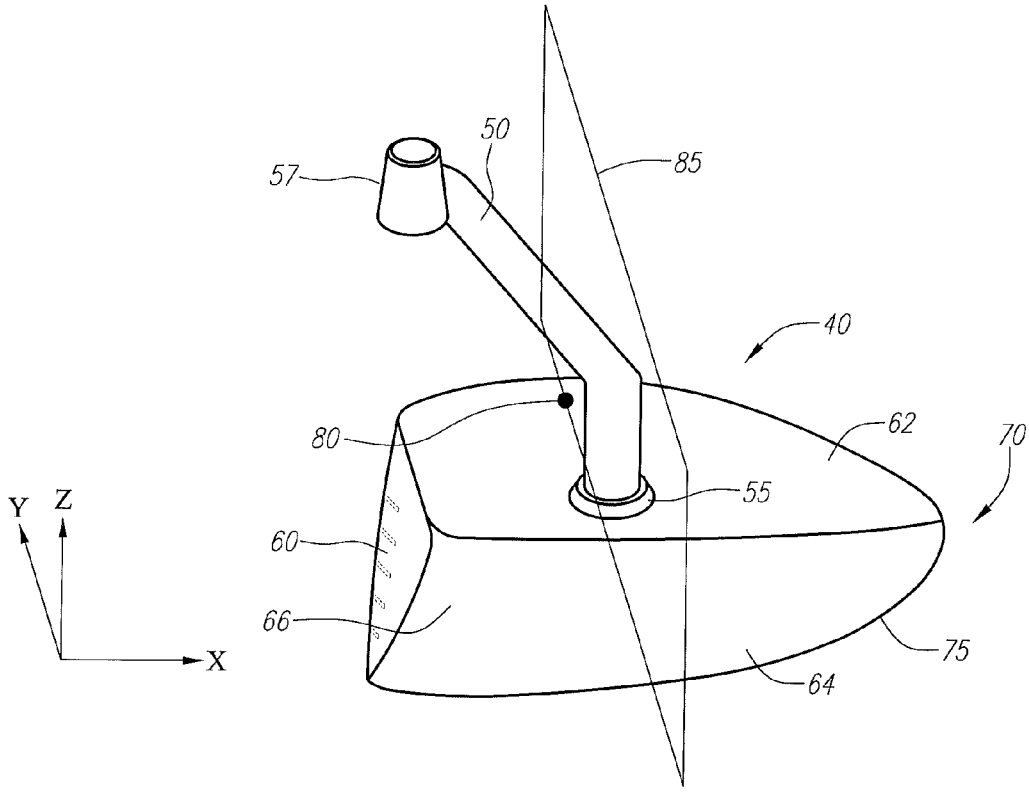
Figure 1I:
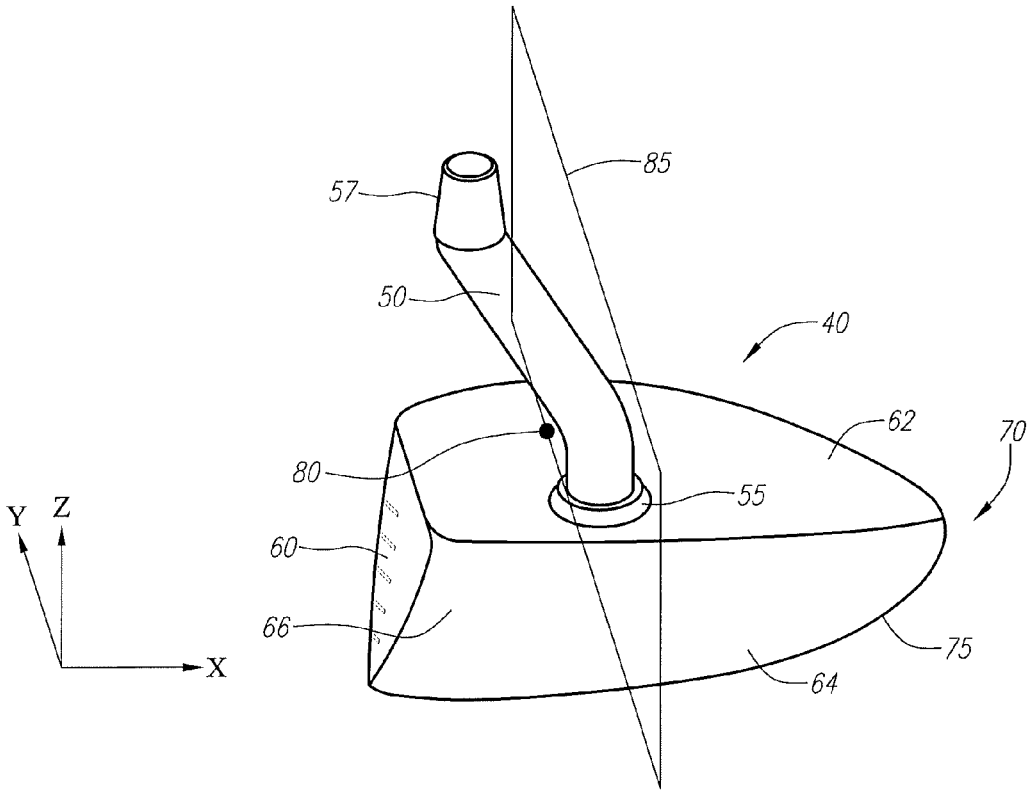
Figure 1J:
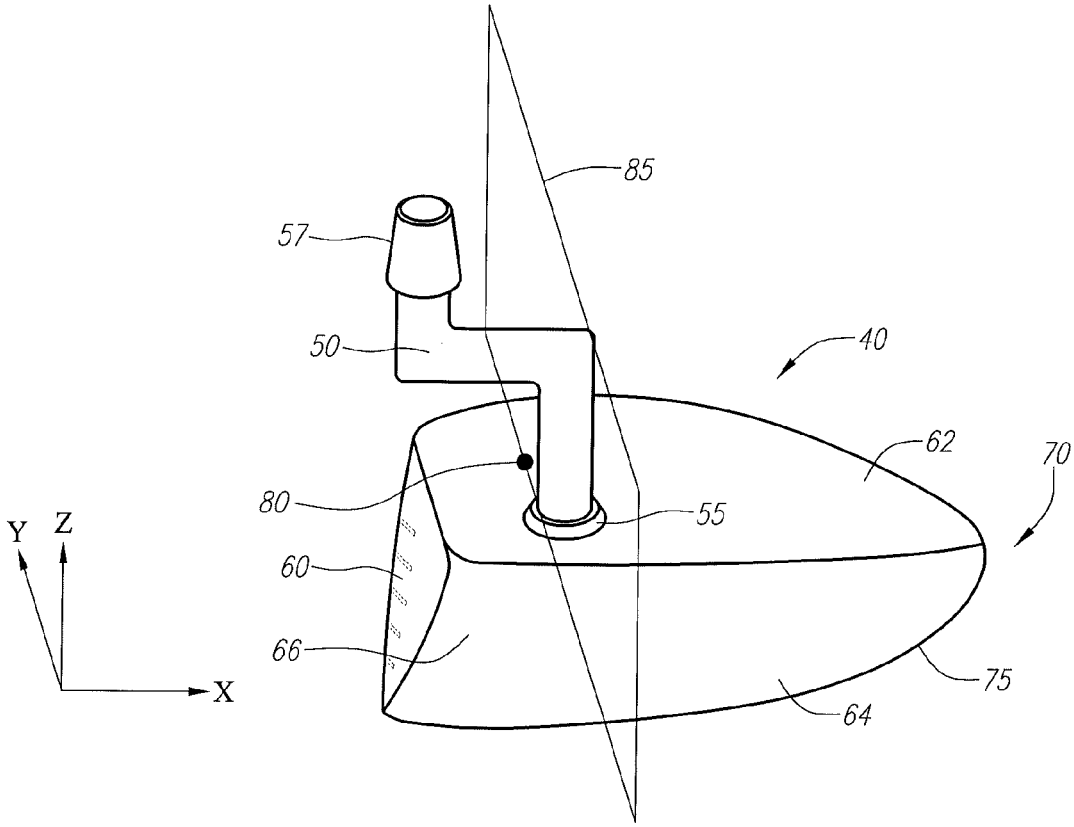
Figure 2:
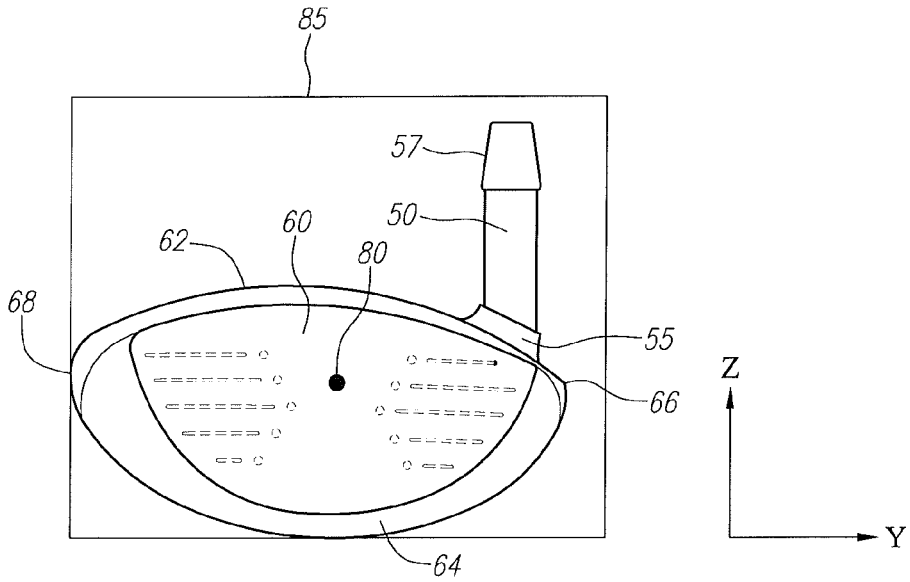
FIG. 2 is a front view of an eleventh embodiment of the present invention.
Figure 3:
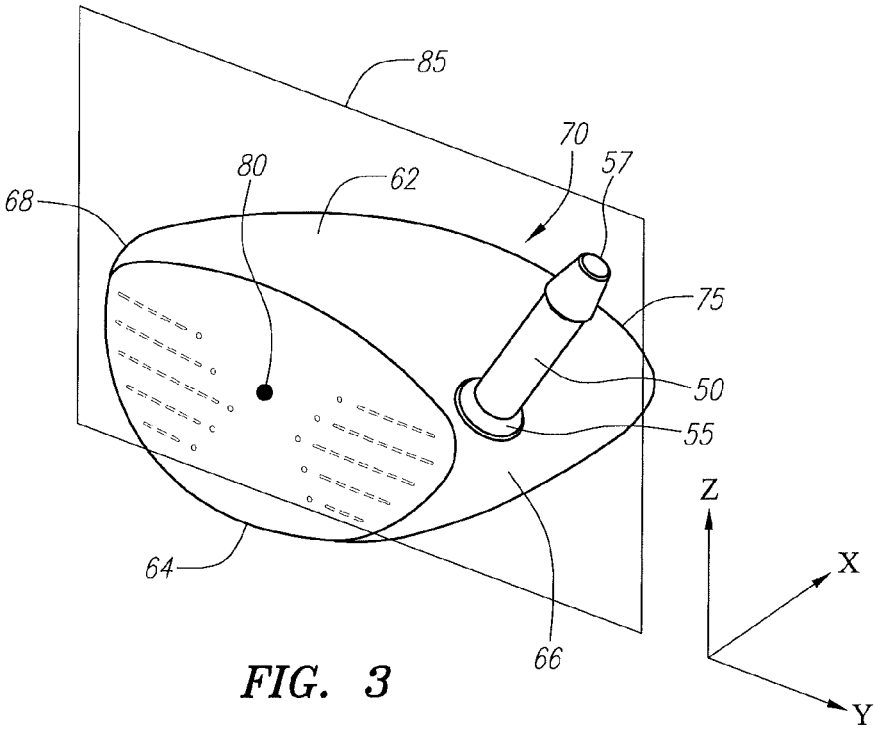
FIG. 3 is a side perspective view of the golf club head shown in FIG. 2.

FIG. 1B shows a hosel 50 having a double bend curved design. FIG. 1C shows a hosel 50 having a single, concave bend design. FIG. 1D shows a hosel 50 having a single bend, straight design. FIG. 1E shows a hosel 50 having a double bend straight design. FIG. 1F shows a hosel 50 having a single, convex bend design. FIG. 1G shows a hosel 50 having a swept back, straight design and a side-mounted shaft connection 57, which extends towards the heel section 66 along the y-axis. FIG. 1H shows a hosel 50 having a swept back, straight design with a single bend and a side-mounted shaft connection 57, which extends towards the heel section 66 along the y-axis. FIG. 1I shows a hosel 50 having a double bend, swept back, straight design. FIG. 1J shows a hosel 50 having an alternative double bend, straight design. In each of FIGS. 1A-1J, the YZ plane 85 intersects both the center of gravity 80 and the head connection portion 55 of the hosel 50. The YZ plane 85 is also shown intersecting the center of gravity 80 and the head connection portion 55 of the hosel 50 in FIGS. 2 and 3.

Figure 4A:
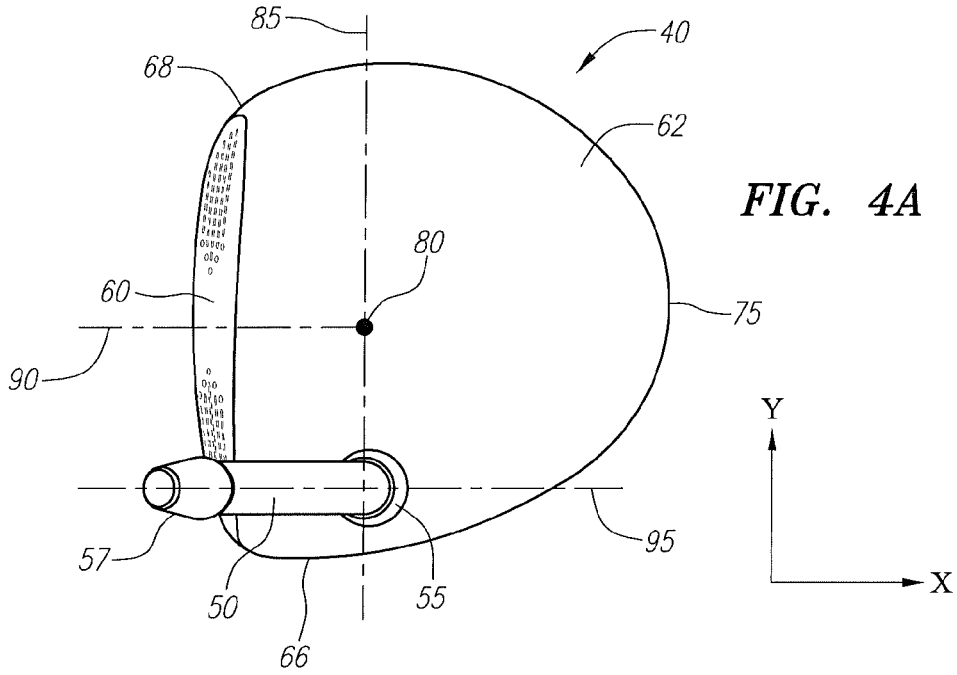
FIG. 4A is a top view of the golf club shown in FIG. 1A.
Figure 4B:
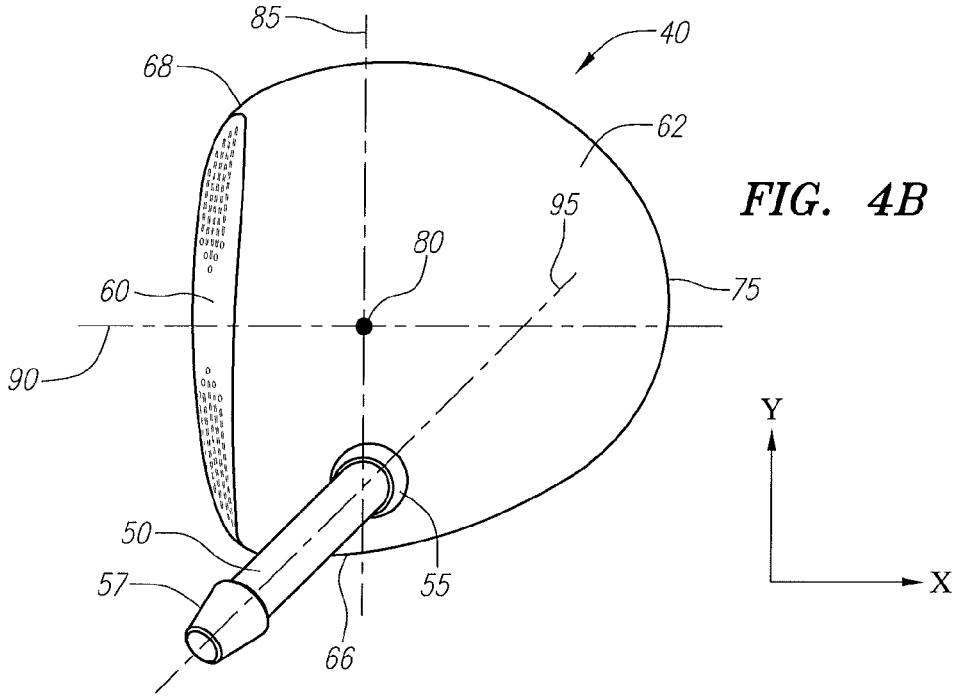
FIG. 4B is a top view of a golf club head according to a twelfth embodiment of the present invention.

In another embodiment of the present invention, shown in FIG. 4A, a plane 95 aligned with the hosel 50 is parallel to an XZ plane 90 defined by the horizontal x-axis and the vertical z-axis. This is further illustrated by the plane 95 shown FIG. 1A. In an alternative embodiment, shown in FIG. 4B, a plane 95 aligned with the hosel 50 intersects the XZ plane 90. These alternative embodiments may be combined with the embodiments disclosed above, as shown in FIGS. 1A, 4A, and 4B. These configurations can create aerodynamic benefits and reduce overall head drag.

In some embodiments of the present invention, the cross-sectional shape of the hosel of may be circular, elliptical, airfoil, symmetrical, or non-uniform to encourage aerodynamic airflow around, over, across, and by the hosel during a swing. Furthermore, the diameters or thicknesses of segments of the hosel of the present invention may, in some embodiments, vary and/or taper to help reduce the drag of air around, over, across, and by the hosel during a swing. Lengths of segments of the hosel also may vary. For example, in an embodiment wherein a segment of the hosel has an airfoil cross-section, that segment preferably has a length of 0.25 to 1.50 inch, and more preferably a length of no more than 1.00 inch.

The hosel of the present invention may be permanently and rigidly affixed to the golf club head, or may be semi-permanently and rigidly affixed, such that the hosel may be adjustably attached to the golf club head to customize the loft, lie, and face angles of the club head for a golfer wishing to alter these variables to his or her liking. In one embodiment, the hosel of the present invention is attached to the club head by affixing it to a spud shaft that is permanently and rigidly affixed to the club head for the express purpose of positioning, locating, and rigidly affixing the hosel in a desired orientation on the club head. In another embodiment, the hosel design of the present invention may be attached to the club head by affixing it into a receiving cavity or a receiving mating location that is designed into the club head for the express purpose of positioning, locating, and rigidly affixing the hosel in a desired orientation onto the club head.

The hosel of the present invention may also have portions that are semi-permanently affixed to one another to modify the way that the shaft and club head are oriented with respect to one another when the hosel is rigidly affixed to the club head. This configuration may be used to modify the loft, lie, and/or face angle parameters of the golf club head as desired by the golfer.

The golf club head of the present invention may be made from various materials, including, but not limited to, titanium and titanium alloys, magnesium, aluminum, tungsten, carbon or graphite composite, plastic, stainless steel, etc. In some embodiments, the entire club head is made of one material. In other embodiments, the club head is made of two or more materials. The golf club of the present invention may also have material compositions such as those disclosed in U.S. Pat. Nos. 6,244,976, 6,332,847, 6,386,990, 6,406,378, 6,440,008, 6,471,604, 6,491,592, 6,527,650, 6,565,452, 6,575,845, 6,478,692, 6,582,323, 6,508,978, 6,592,466, 6,602,149, 6,607,452, 6,612,398, 6,663,504, 6,669,578, 6,739,982, 6,758,763, 6,860,824, 6,994,637, 7,025,692, 7,070,517, 7,112,148, 7,118,493, 7,121,957, 7,125,344, 7,128,661, 7,163,470, 7,226,366, 7,252,600, 7,258,631, 7,314,418, 7,320,646, 7,387,577, 7,396,296, 7,402,112, 7,407,448, 7,413,520, 7,431,667, 7,438,647, 7,455,598, 7,476,161, 7,491,134, 7,497,787, 7,549,935, 7,578,751, 7,717,807, 7,749,096, and 7,749,097, the disclosure of each of which is hereby incorporated in its entirety herein.

The golf club head of the present invention may be constructed to take various shapes, including traditional, square, rectangular, or triangular. In some embodiments, the golf club head of the present invention takes shapes such as those disclosed in U.S. Pat. Nos. 7,163,468, 7,166,038, 7,169,060, 7,278,927, 7,291,075, 7,306,527, 7,311,613, 7,390,269, 7,407,448, 7,410,428, 7,413,520, 7,413,519, 7,419,440, 7,455,598, 7,476,161, 7,494,424, 7,578,751, 7,588,501, 7,591,737, and 7,749,096, the disclosure of each of which is hereby incorporated in its entirety herein.

The golf club head of the present invention may also have variable face thickness, such as the thickness patterns disclosed in U.S. Pat. Nos. 5,163,682, 5,318,300, 5,474,296, 5,830,084, 5,971,868, 6,007,432, 6,338,683, 6,354,962, 6,368,234, 6,398,666, 6,413,169, 6,428,426, 6,435,977, 6,623,377, 6,997,821, 7,014,570, 7,101,289, 7,137,907, 7,144,334, 7,258,626, 7,422,528, 7,448,960, 7,713,140, the disclosure of each of which is incorporated in its entirety herein. The golf club of the present invention may also have the variable face thickness patterns disclosed in U.S. Patent Application Publication No. 20100178997, the disclosure of which is incorporated in its entirety herein.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim as our invention:

1. A golf club head comprising a face component;

an aft body comprising a crown, a sole, a heel section, and a toe section;

a hosel having a head connection portion; and a center of gravity located at coordinates defined by an x-axis extending from the face towards a rear portion of the club head, a y-axis extending from the heel section towards the toe section, and a z-axis extending from the sole to the crown;

wherein a YZ plane defined by the y-axis and the z-axis that intersects the center of gravity also intersects the head connection portion, and wherein the hosel comprises a hosel plane that intersects and XZ plane defined by the x-axis and the z-axis.

2. The golf club head of claim 1, further comprising a hosel plane that is parallel to an XZ plane defined by the x-axis and the z-axis.

3. The golf club head of claim 1, wherein a cross-sectional shape of the hosel is selected from a group consisting of circular, elliptical, airfoil symmetrical, and non-uniform.

4. The golf club head of claim 3, wherein at least part of the hosel has an airfoil cross-sectional shape.

5. The golf club head of claim 4, wherein the part of the hosel having an airfoil cross-sectional shape has a length of 0.25 to 1.50 inches.

6. The golf club head of claim 5, wherein the part of the hosel having an airfoil cross-sectional shape has a length that is less than or equal to 1.00 inch.

7. The golf club head of claim 1, wherein the face component has a striking portion with variable thickness.

8. The golf club head of claim 1, wherein an overall shape of the golf club head is selected from a group consisting of square, rectangular, and triangular.

9. The golf club head of claim 1, wherein the face component comprises a first material, the crown and sole comprise a second material, and the hosel comprises a third material.

10. The golf club head of claim 1, wherein the hosel is constructed from of a lightweight material selected from the group consisting of composite, aluminum, titanium, magnesium, and plastic.

11. The golf club head of claim 1, wherein the hosel is permanently affixed to the golf club head.

12. The golf club head of claim 1, wherein the hosel is semi-permanently affixed to the golf club head.

13. The golf club head of claim 1, wherein the YZ plane intersects a midpoint of the head connection portion.

* * * * *